US009599437B2

(12) United States Patent
Eble

(10) Patent No.: US 9,599,437 B2
(45) Date of Patent: Mar. 21, 2017

(54) QUICK DETACH ACCESSORY MOUNT FOR A RIFLE

(71) Applicant: Russell Eble, Pittsburgh, PA (US)

(72) Inventor: Russell Eble, Pittsburgh, PA (US)

( * ) Notice: Subject to any disclaimer, the term of this patent is extended or adjusted under 35 U.S.C. 154(b) by 115 days.

(21) Appl. No.: 13/968,588

(22) Filed: Aug. 16, 2013

(65) Prior Publication Data

US 2016/0161214 A1 Jun. 9, 2016

Related U.S. Application Data

(63) Continuation-in-part of application No. 13/795,824, filed on Mar. 12, 2013, now abandoned.

(60) Provisional application No. 61/764,701, filed on Feb. 14, 2013.

(51) Int. Cl.
*F41C 27/18* (2006.01)
*F41G 11/00* (2006.01)
*F41A 21/44* (2006.01)

(52) U.S. Cl.
CPC ..... *F41G 11/003* (2013.01); *F41C 27/18* (2013.01); *F41A 21/44* (2013.01)

(58) Field of Classification Search
CPC ..... F41C 27/00; F41C 23/16; F41C 23/22; F41C 23/00; F41G 11/003; F41A 11/00
USPC ..... 42/90, 71.01, 72, 84, 124, 86
See application file for complete search history.

(56) References Cited

U.S. PATENT DOCUMENTS

| | | | | |
|---|---|---|---|---|
| 4,494,328 | A * | 1/1985 | Stevens | F41C 27/00 42/115 |
| 4,539,769 | A * | 9/1985 | Stevens | F41C 27/00 42/115 |
| 4,571,870 | A * | 2/1986 | Heideman | F41G 11/001 42/1.01 |
| 4,580,362 | A * | 4/1986 | Stevens | F41G 1/34 42/1.01 |
| 6,115,952 | A * | 9/2000 | Rigler | F41C 27/00 362/110 |
| 6,289,621 | B1 * | 9/2001 | Vendetti | F41C 27/18 42/106 |
| 6,385,892 | B1 * | 5/2002 | Vendetti | F41C 27/00 42/86 |
| 9,127,904 | B2 * | 9/2015 | Moore, Jr. | F41C 27/00 |
| 2011/0214329 | A1 * | 9/2011 | Green | F41C 27/00 42/90 |

* cited by examiner

*Primary Examiner* — Jonathan C Weber
(74) *Attorney, Agent, or Firm* — Nils H. Ljungma & Associates

(57) ABSTRACT

A quick detach accessory mount for a rifle and a method of using an accessory mount in combination with a rifle.

1 Claim, 13 Drawing Sheets

QUICK DETACH ACCESSORY MOUNT FOR A RIFLE

BACKGROUND

1. Technical Field

The present application relates to a quick detach accessory mount for a rifle or shotgun or other weapon, for example a grenade launcher.

2. Background Information

Background information is for informational purposes only and does not necessarily admit that subsequently mentioned information and publications are prior art.

The M16 automatic rifle has been one of the standard issue weapons of the United States military and civilian police departments for decades. The rifle design was originated by E. M. Stoner and developed by Fairchild Engine and Airplane Company in the 1950's. Modified versions of the M16 designated as the M16A1 and M16A2 are currently in use by armed forces in the U.S. and throughout the world.

There are additional versions of the M16 rifle, including but not limited to: the M16A3 and M16A4.

The M4 carbine is a family of firearms tracing its lineage back to earlier carbine versions of the M16, all based on the original AR-15 designed by Eugene Stoner and made by ArmaLite. It is a shorter and lighter version of the M16A2 assault rifle.

OBJECT OR OBJECTS

An object of the present application is to permit a quick semi-permanent mounting of accessories underneath and/or adjacent to the barrel of a rifle.

SUMMARY

The present application relates to a quick detach accessory mount (QDAM) or a rapid attach/detach accessory mount (RADAM), which is compatible with M16 rifles, M4 carbines, Mossberg 590 shotguns, and other weapons with an M16-style bayonet lug. The quick detach accessory mount may be configured to quickly attach and detach to a standard bayonet mount and provide a stable platform for up to three accessories such as lasers, flashlights, various illuminators, bipods, and other accessories that utilize any standard rail mounting system. The quick detach accessory mount may provide three NATO Accessory Rails (STANAG 4694) or other various rail types under the barrel of a rifle at three o'clock, six o'clock, and nine o'clock positions. The quick detach accessory mount may be backwardly compatible with all devices and/or accessories using the MIL-STD 1913 Picatinnny rail system. Picatinny rails are manufactured and sold by LEAPERS, INC., which is headquartered at 32700 Capitol Street, Livonia, Mich. 48150. Accessories may be quickly attached and detached to the quick detach accessory mount.

The quick detach accessory mount may comprise an extender, in order to fit rifles with a longer space between the bayonet lug and the barrel muzzle. In one possible embodiment of the present application, the extender may be one and one-half inches in length in order to fit a civilian and/or law enforcement version of a military M4 carbine, which has a barrel that is one and one-half inches longer than the barrel of an M16 rifle.

The quick detach accessory mount may be mounted to a weapon with three motions, without weapon modifications. This permits a weapon to be configured for specific missions without a typical semi-permanent mounting of accessories. The quick detach accessory mount may be used only when needed, which may save wear and tear on both accessories and weapons, as well as allowing a weapon to be as light as possible. The quick detach accessory mount may be utilized or adapted for use with any weapon using a bayonet mounting system or equivalent mounting system.

To attach the quick detach accessory mount to a rifle, the first step is to open the barrel ring by rotating the locking mechanism from a first position. Once the barrel ring is opened and/or loosened, the barrel ring may be slid into place over the muzzle and/or flash hider and/or barrel of the rifle. The second step is to briskly snap the quick detach accessory mount into place by snapping the bayonet stud and/or bayonet lug into the T-shaped slot. The bayonet stud and/or bayonet lug is engaged with the ball detent and levers of the quick detach accessory mount. The third step is to flip the locking mechanism down by rotating the locking mechanism back into its first position. The quick detach accessory mount is then locked into place on the rifle. Accessories may then be attached and/or detached onto the rifle via the quick detach accessory mount.

To detach the quick detach accessory mount from the rifle, the first step is to open and/or loosen the barrel ring by rotating the locking mechanism from its first position. Once the barrel ring is opened and/or loosened, the second step is to grasp the levers by the finger grips and open the levers, like to remove a bayonet from a rifle. Once the quick detach accessory mount is disengaged from the bayonet lug, the barrel ring may be slid off the barrel and/or muzzle and/or flash hider and removed from the rifle.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

DESCRIPTION OF EMBODIMENT OR EMBODIMENTS

Figure 1:
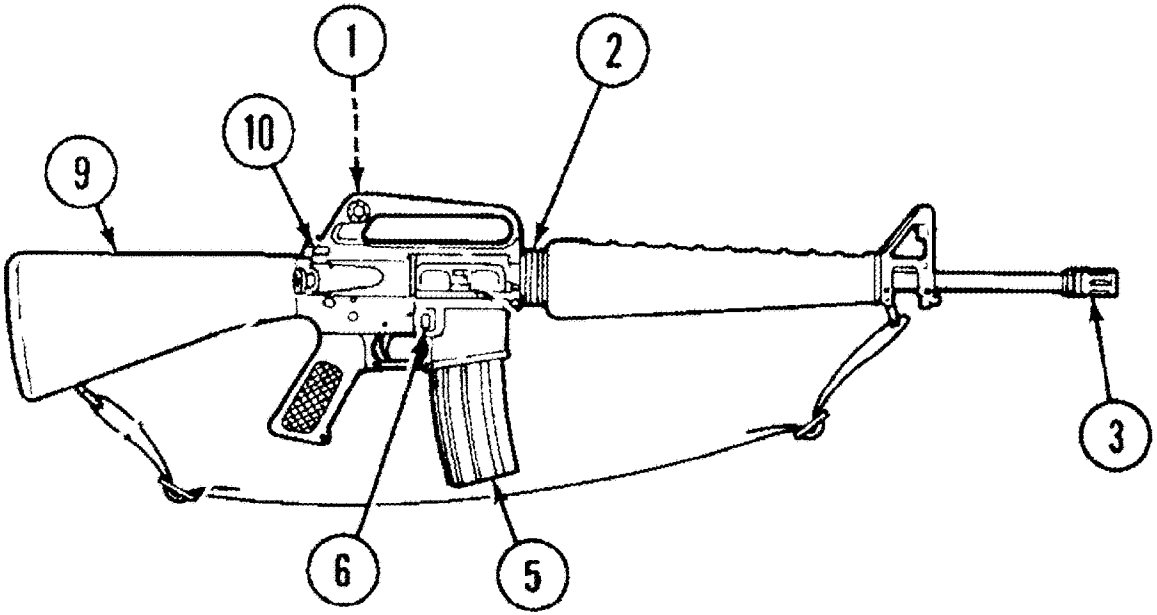
FIG. 1 PRIOR ART
FIG. 1 shows the right side of an M16 rifle.

FIG. 1 is a drawing of the right side of an M16 rifle. The M16 comprises a rear sight windage knob 1, a slipring 2, a muzzle 3, a magazine 5, a magazine release button 6, a stock 9, and a charging handle 10.

Figure 2:
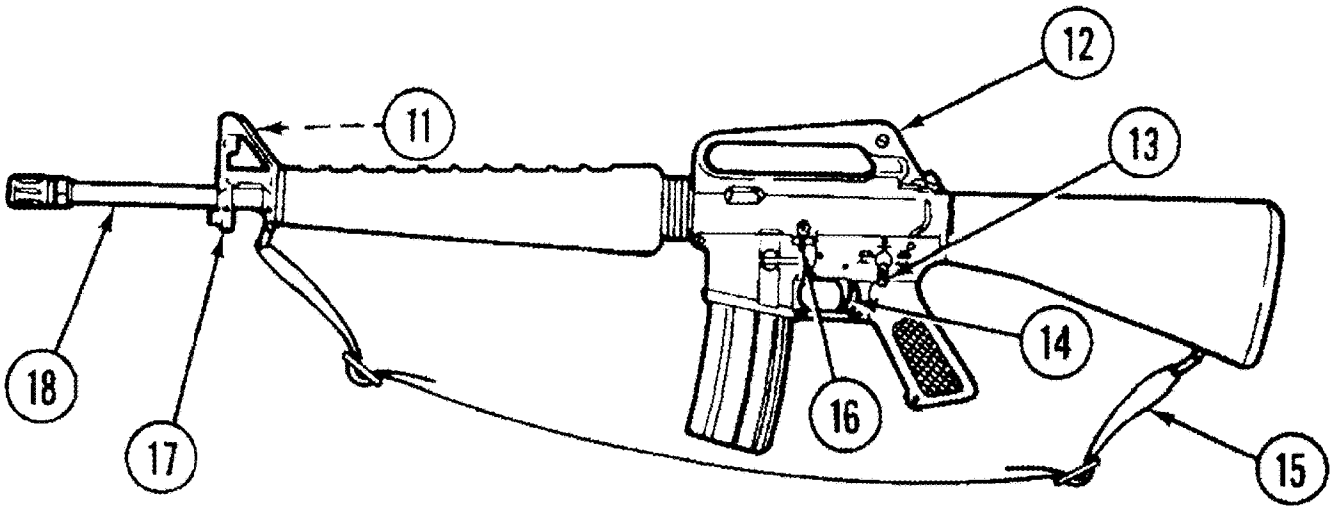
FIG. 2 PRIOR ART
FIG. 2 shows the left side of the M16 rifle in FIG. 1.

FIG. 2 is a drawing of the left side of the M16 rifle as seen in FIG. 1. The M16 comprises a front sight assembly 11, a rear sight drum 12, a selector lever 13, a trigger 14, a sling 15, a bolt catch 16, a bayonet stud 17, and a barrel 18.

Figure 3:
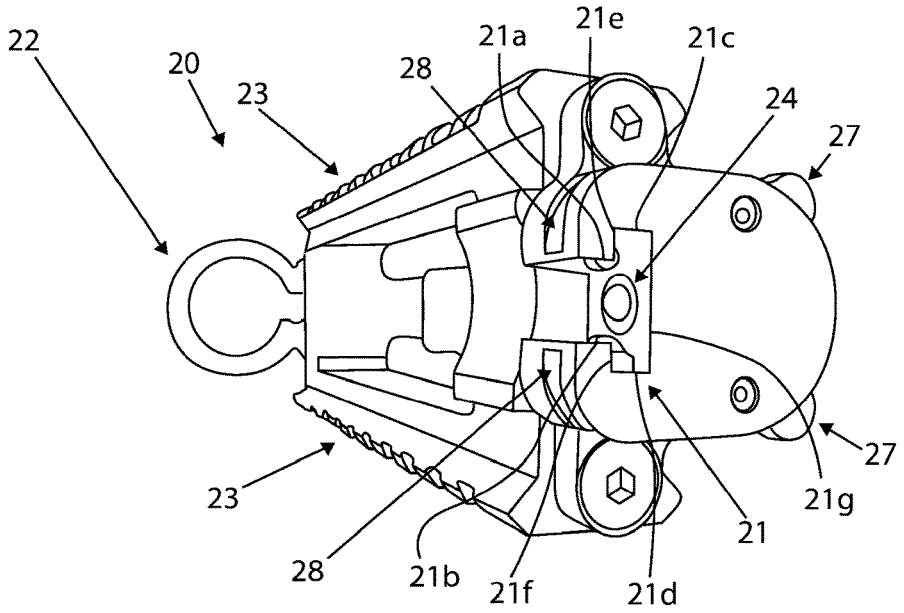
FIG. 3 shows another picture of one possible embodiment of the present application.

FIG. 3 shows a quick detach accessory mount 20. The quick detach accessory mount 20 comprises the bayonet stud slot 21, the barrel ring 22, and Picatinny rails 23. The bayonet stud slot 21, as seen in the embodiment shown in FIG. 4, comprises a T-shape. The T-shape comprises surfaces 21*a*, 21*b*, 21*c*, and 21*d*. The surfaces 21*a*, 21*b*, 21*c*, and 21*d* are parallel or substantially parallel to one another. The T-shape also comprises surfaces 21*e*, 21*f*, and 21*g*. The surfaces 21*e*, 21*f*, and 21*g* are parallel or substantially to one another. The surfaces 21*a*, 21*b*, 21*c*, and 21*d* may be perpendicular or substantially perpendicular to the surfaces 21*e*, 21*f*, and 21*g*.

Inside the bayonet stud slot 21 is an engaging structure 24. The engaging structure 24 is configured to engage with the bayonet stud and lock the quick detach accessory mount 20 into place on the M16 rifle. The engagement structure 24, in one possible embodiment of the present application, may comprise a detent 24 or ball detent 24. The detent 24 may be a spring-loaded detent 24 configured to prevent, reduce, and/or minimize the quick detach accessory mount 20 from moving and/or rocking while in place on the rifle. The engaging structure 24 may be configured to steady the quick detach accessory mount 20 and hold the quick detach accessory mount 20 so that it does not move around.

The quick detach accessory mount 20 may also comprise two levers 28. Each lever 28 may comprise a finger grip 27. The finger grip 27 may comprise ridges or roughing around the edge to permit gripping of the lever 28 and/or finger grip 27 and therefore permit manipulation of the lever 28. The levers 28 may hold the quick detach accessory mount 20 in place on the rifle in conjunction with the ball detent 24. The levers 28 may be configured to grip the bayonet stud or bayonet lug of the rifle. The quick detach accessory mount 20 may be configured to be snapped into place on a rifle. The levers 28 may be disengaged from the bayonet stud or bayonet lug to permit removal, release, and/or detachment of the quick detach accessory mount 20 from a rifle.

The quick detach accessory mount 20 may be configured to slide onto the barrel of an M16 rifle before being snapped into place. The barrel ring 22 may be configured to slide over a muzzle and/or flash hider of an M16 rifle. The quick detach accessory mount 20 may be configured to lock into place or be secured or substantially secured into place on the barrel and/or flash hider of a rifle by engaging the ball detent 24 in the bayonet stud slot 21 with the bayonet stud and gripping the bayonet stud with the levers 28 of the rifle as well as engaging the barrel ring 22 with the barrel and/or flash hider of the rifle. The quick detach accessory mount 20 may also be detached and/or disengaged from the rifle by disengaging the detent 24 in the bayonet stud slot 21 from the bayonet stud of the rifle and releasing the levers 28 as well as disengaging the barrel ring 22 from the barrel and/or flash hider of the rifle.

Figure 4:
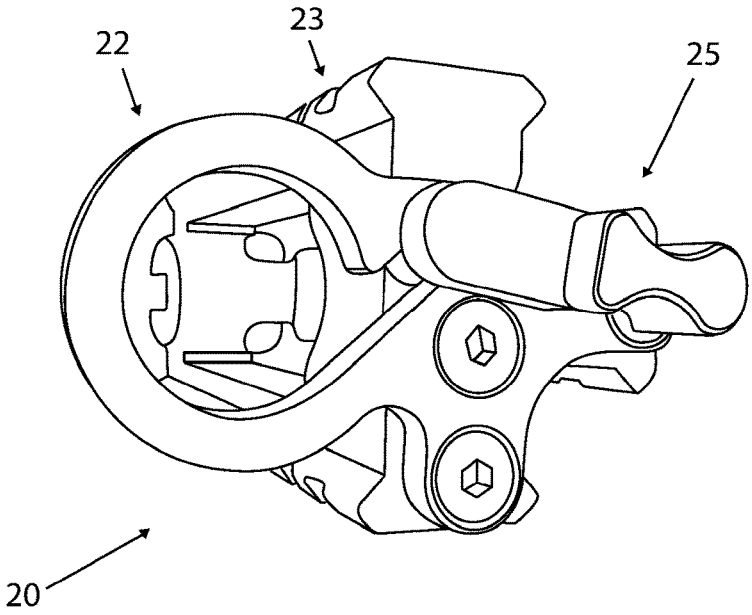
FIG. 4 shows another picture of one possible embodiment of the present application.

FIG. 4 shows the quick detach accessory mount 20. The quick detach accessory mount 20 comprises a locking mechanism 25, which locks or substantially locks the barrel ring 22 around the barrel and/or flash hider of an M16 rifle. The locking mechanism 25 may be configured to prevent, restrict, and/or minimize movement of the quick detach accessory mount 20 during use. The locking mechanism 25 may comprise a cam. The locking mechanism may be pushed in a counter-clockwise direction to open and/or loosen the barrel ring 22. Once the barrel ring 22 is opened or loosened, the barrel ring 22 may then fit over the muzzle and/or flash hider of a rifle. Once the barrel ring 22 is in place over the muzzle and/or barrel of the rifle, the locking mechanism 25 may then be rotated in a clockwise direction. The spring tension of the locking mechanism 25 may hold the barrel ring 22 in place over the flash hider and/or barrel. To disengage and/or detach the quick detach accessory mount 20 from a rifle, the locking mechanism 25 may be rotated in a counter-clockwise direction to open and/or loosen the barrel ring 22. The barrel ring 22 may then be removed from around the flash hider and/or barrel of the rifle.

Figure 6:
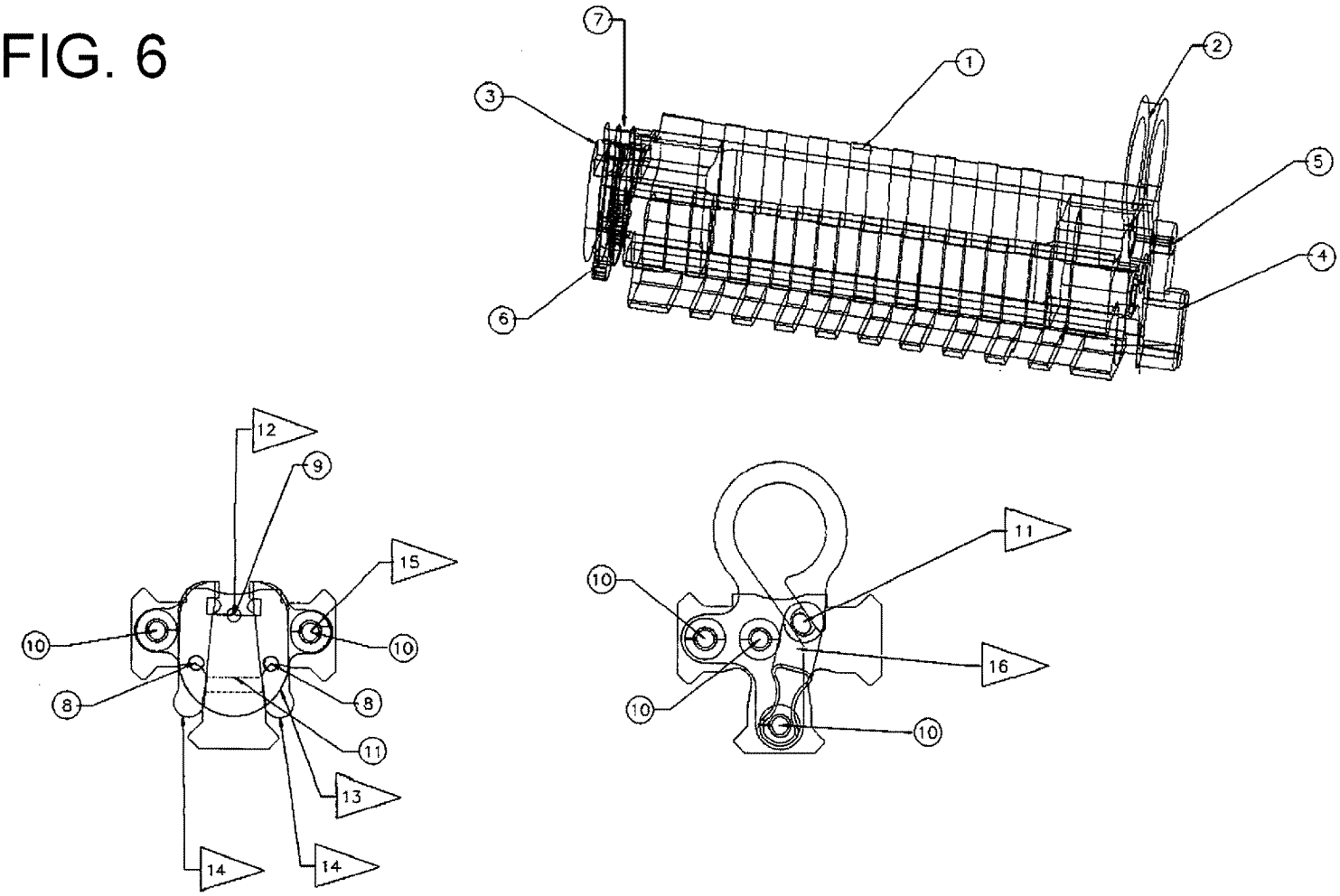
FIG. 6 is a drawing of one possible embodiment of a quick detach accessory mount of the present application.

FIG. 6 is a drawing of one possible embodiment of a quick detach accessory mount of the present application. FIG. 6 comprises a perspective view, a view of the barrel ring, and a view of the bayonet lug slot and levers.

Figure 7:
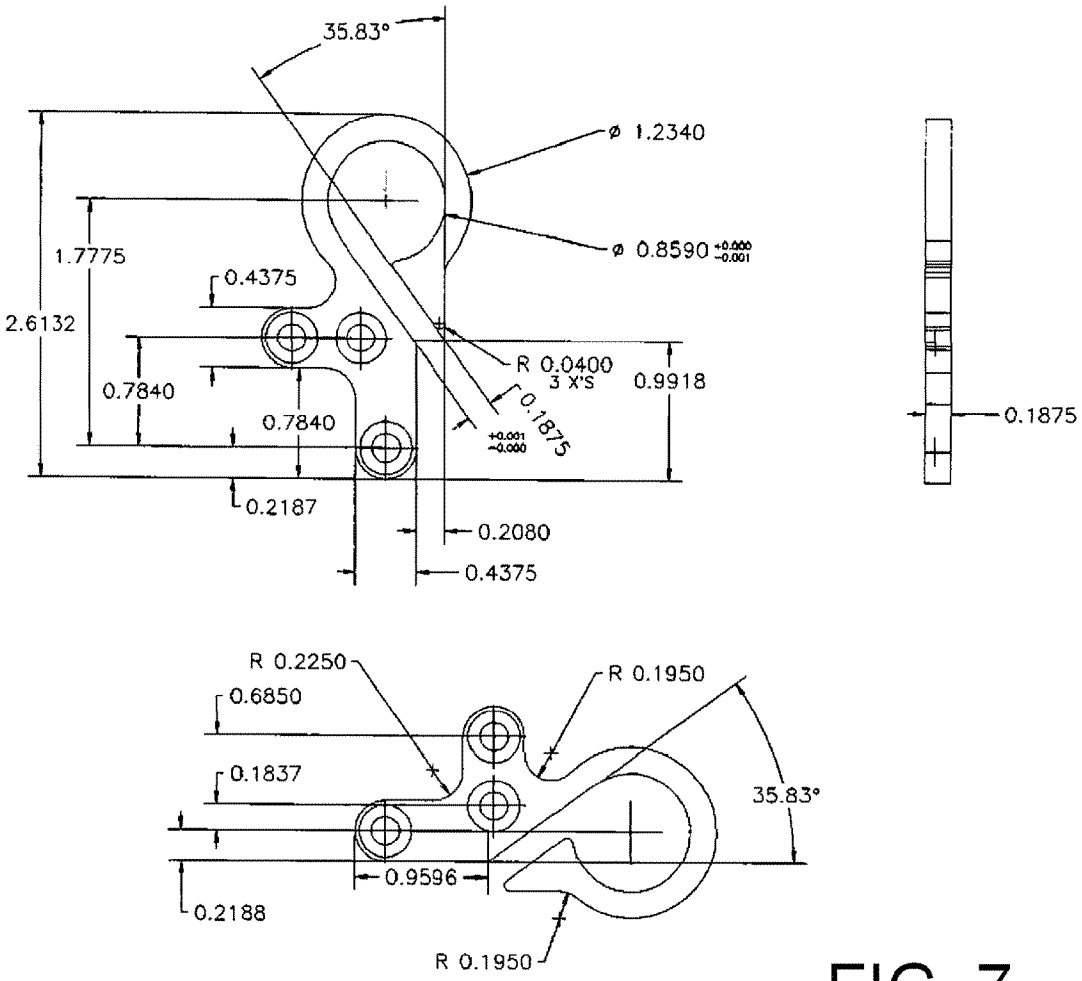
FIG. 7 is a drawing of a barrel ring or muzzle ring clamp of one possible embodiment of a quick detach accessory mount of the present application.

FIG. 7 is a drawing of one possible embodiment of a barrel ring of a quick detach accessory mount of the present application.

Figure 8:
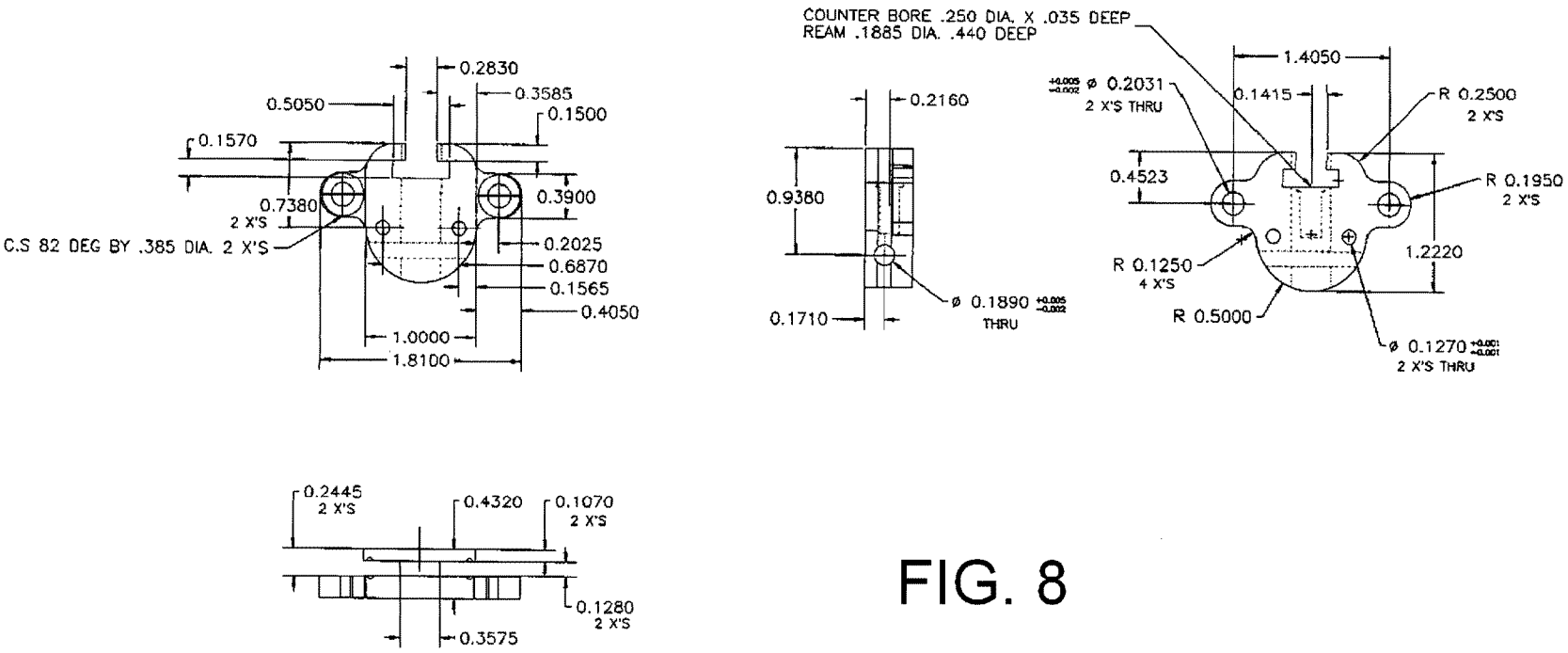
FIG. 8 is a drawing of a bayonet stud slot or bayonet stud mounting slot of one possible embodiment of a quick detach accessory mount of the present application.

FIG. 8 is a drawing of one possible embodiment of the T-shaped bayonet stud slot and the grippers of a quick detach accessory mount of the present application.

Figure 9:
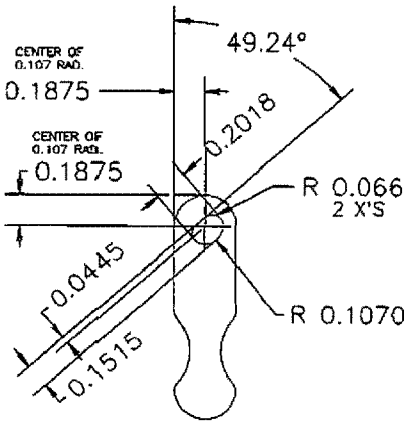
FIG. 9 is a drawing of a locking mechanism or locking lever of one possible embodiment of a quick detach accessory mount of the present application.
Figure 9:
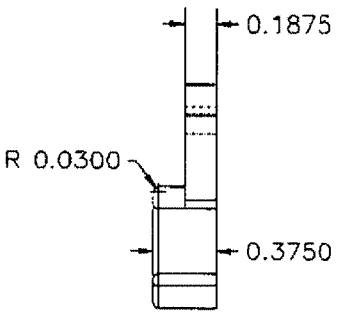
Figure 9:
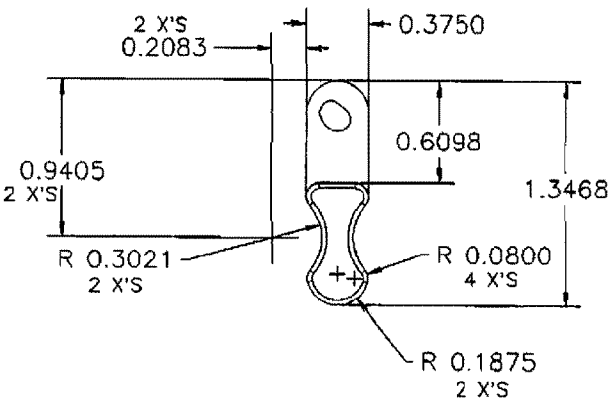

FIG. 9 is a drawing of one possible embodiment of a locking mechanism of a quick detach accessory mount of the present application.

Figure 10:
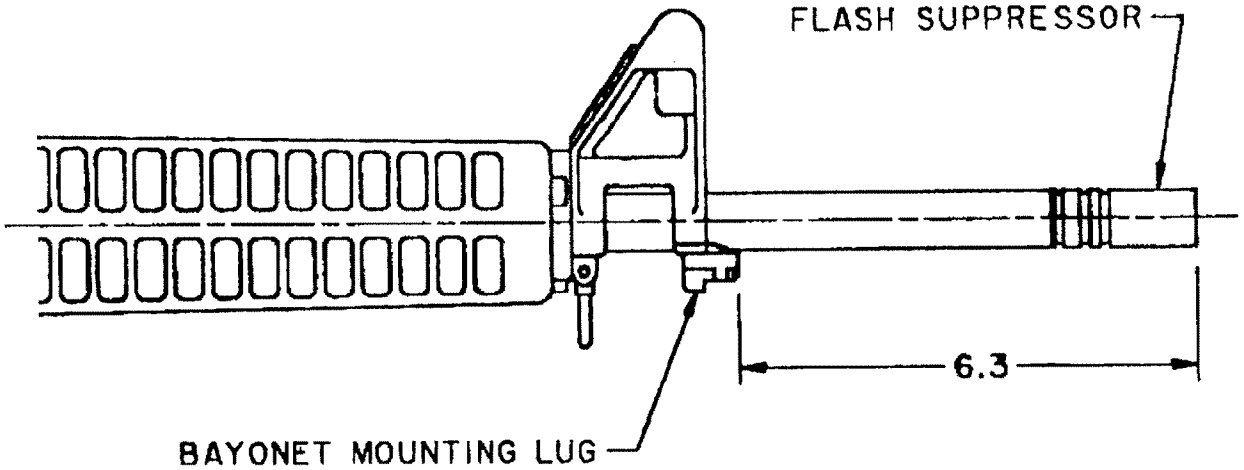
FIG. 10 PRIOR ART
FIG. 10 is a drawing of a barrel of rifle comprising a flash suppressor and a bayonet mounting lug.

FIG. 10 is a drawing of a portion of a rifle. This portion comprises a flash suppressor and a bayonet mounting lug.

Figure 11:
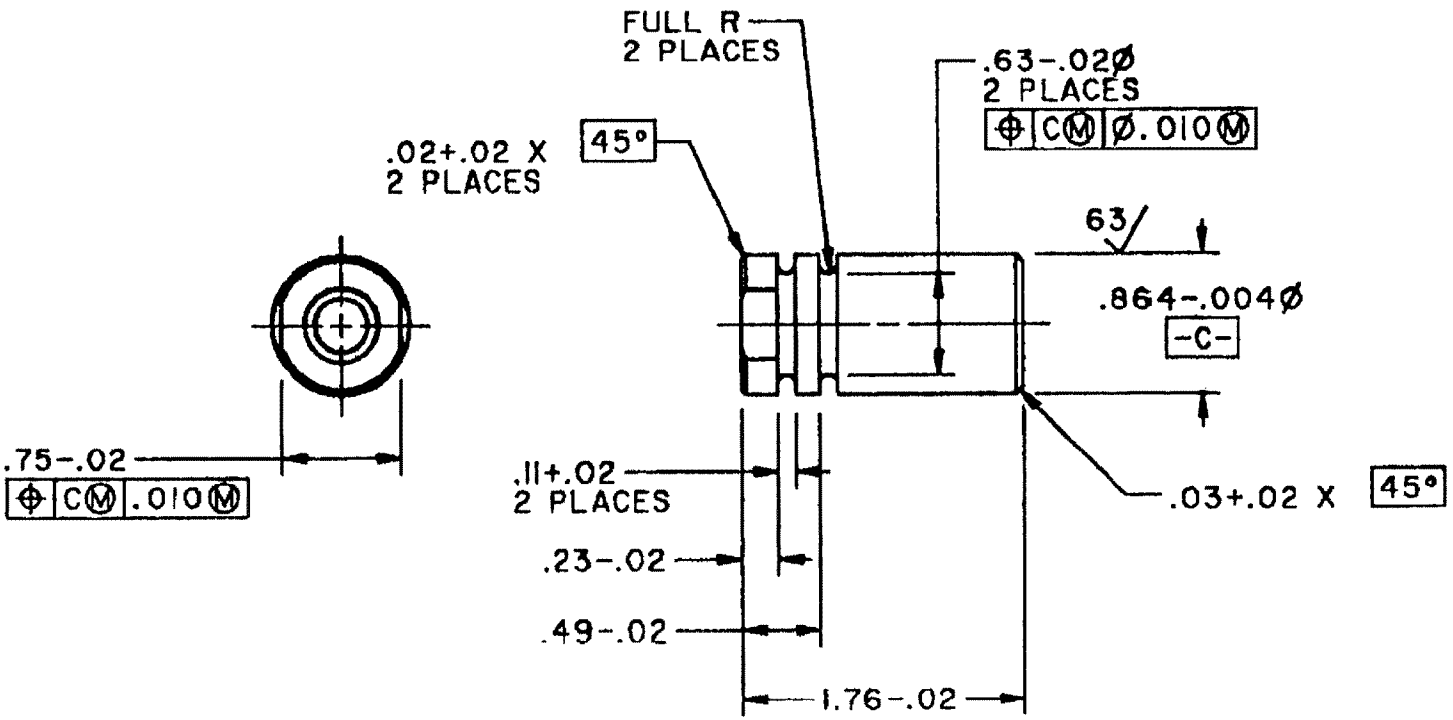
FIG. 11 is a drawing of a flash suppressor of a rifle.

FIG. 11 is a drawing of a flash suppressor of a rifle.

Figure 12:
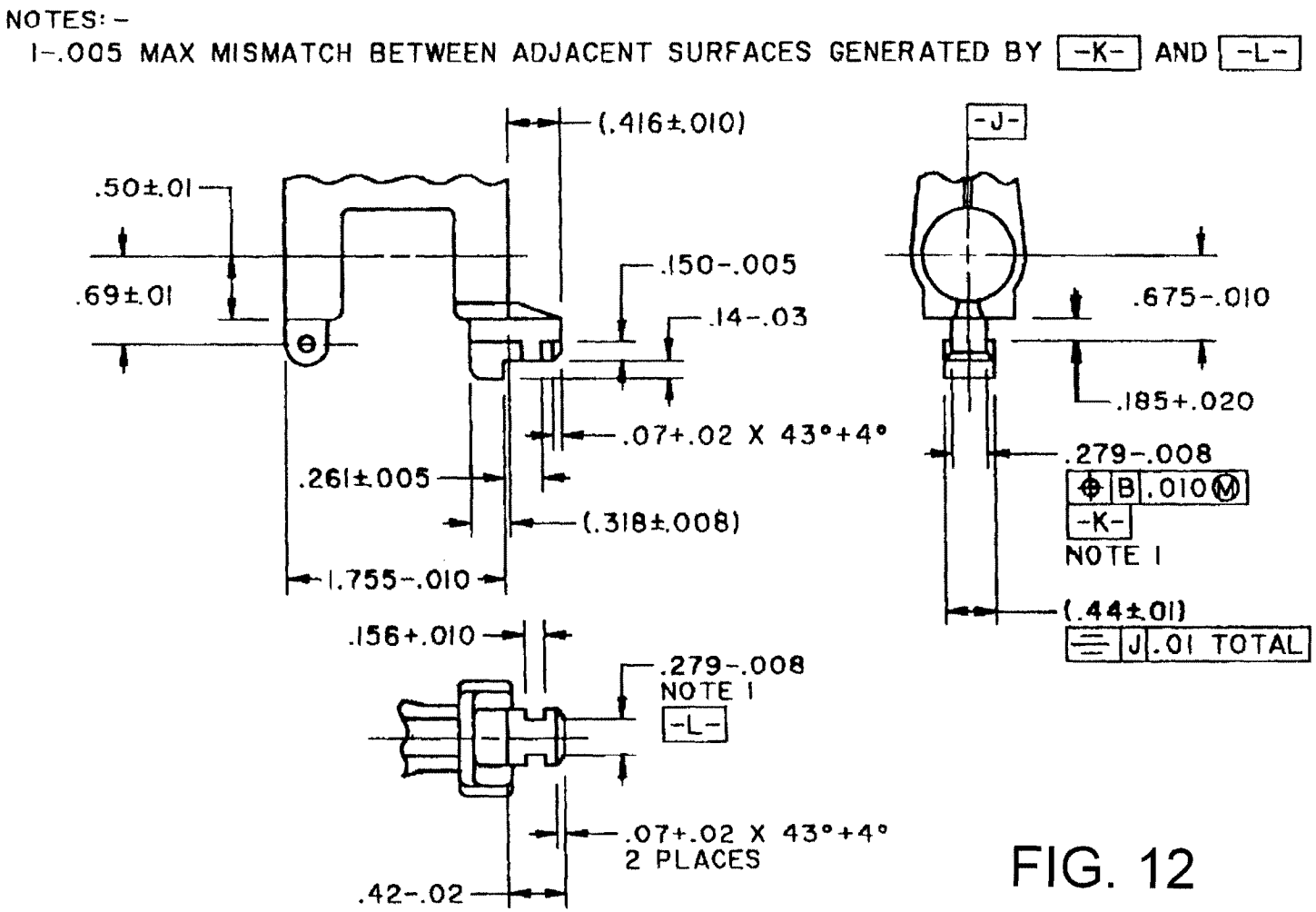
FIG. 12 is a drawing of a bayonet stud of a rifle.

FIG. 12 is a drawing of a bayonet mounting lug of a rifle.

Figure 13:
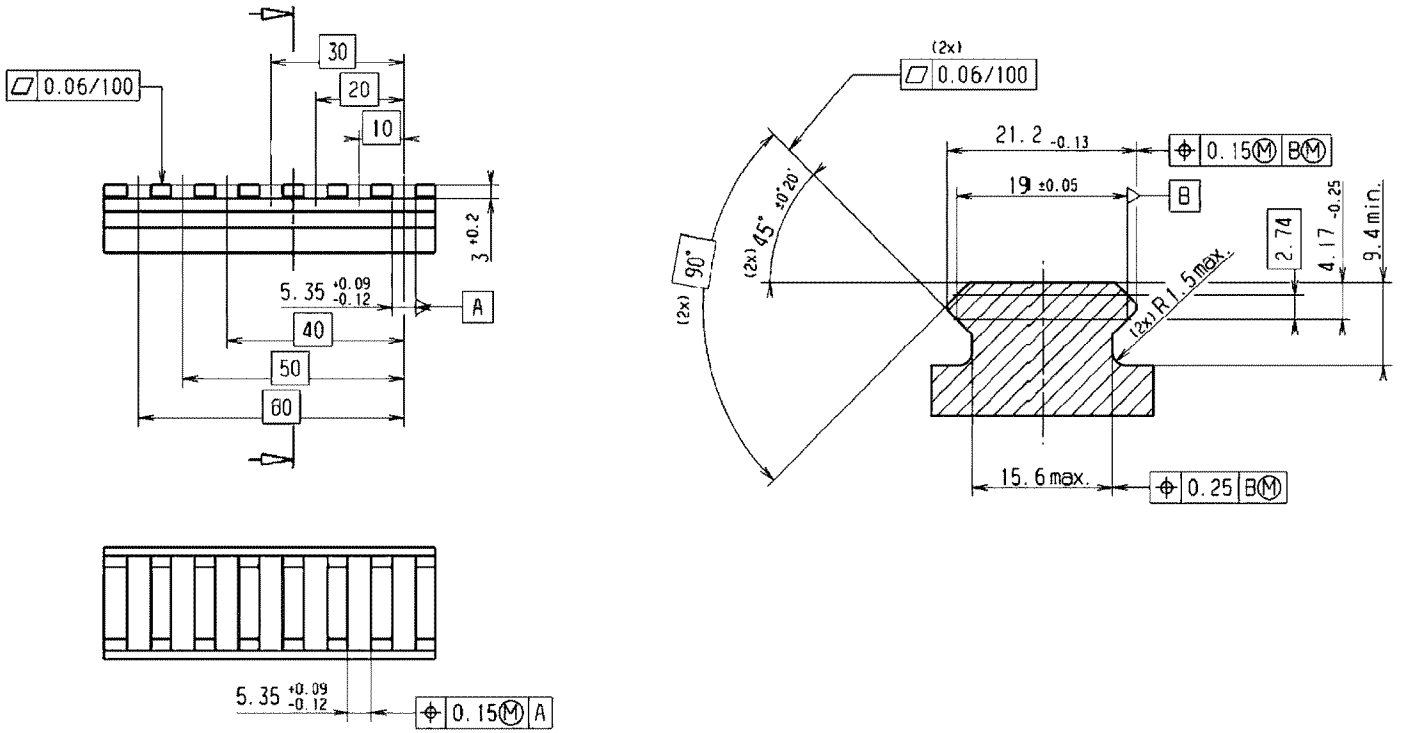
FIG. 13 is a drawing of a NATO accessory rail.

FIG. 13 is a drawing of a NATO accessory rail utilized or adapted for use with rifles.

In at least one possible teaching, a quick detach accessory mount comprising a bayonet lug can be utilized or adapted for use with an AK47 rifle.

In at least one possible teaching, a quick detach accessory mount comprising a bayonet lug can be utilized or adapted for use with an M16/AR15 rifle, with an extension.

In at least one possible teaching, a quick detach accessory mount comprising a bayonet lug can be utilized or adapted for use with an M1A/M14 rifle.

In at least one possible teaching, a quick detach accessory mount comprising a bayonet lug can be utilized or adapted for use with an M1/2/3 carbine.

In at least one possible teaching, a quick detach accessory mount comprising a bayonet lug can be utilized or adapted for use with a twelve-gauge shotgun.

Figure 5:
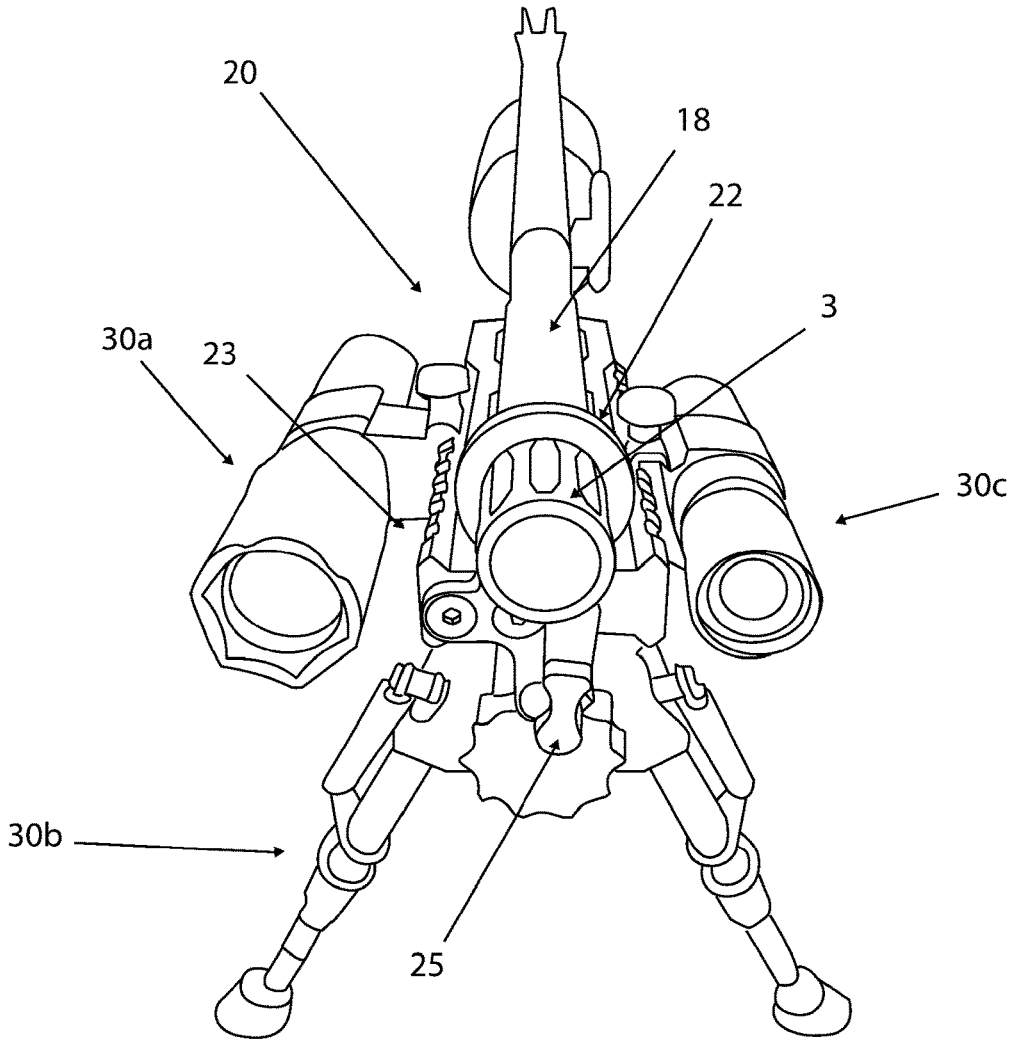
FIG. 5 shows a picture of a top and front perspective view of a quick detach accessory mount disposed on a rifle according to one possible embodiment of the present application.

FIG. 5 is a drawing of a quick detach accessory mount 20 of the present application disposed on a rifle, taken from the muzzle-end of the rifle. The rifle comprises a muzzle 3 and a barrel 18. The quick detach accessory mount 20 comprises a barrel ring 22, a locking mechanism 25, and rails 23. As shown in FIG. 23, accessories 30 are mounted on the rails 23. The accessories include a flashlight 30*a*, a bipod mount 30*b*, and a SureFire 6P® Original incandescent flashlight 30*c*. Some accessories may include accessories manufactured by SureFire, LLC, having headquarters located at 18300 Mount Baldy Circle, Fountain Valley, Calif. 92708.

Some examples of various attachments that may be used in combination with the quick detach accessory mount of the present application may include: flashlights and/or illuminators in the visible spectrum of light, flashlights and/or illuminators in the infrared spectrum, strobes in either the visible or infrared spectrum, laser sights in the visible spectrum, laser sights in the infrared spectrum, combination devices of both laser sights and illuminators, bipods, vertical foregrips, non-lethal visual disruption lasers, dazzlers, and ocular interruption devices, weapons cameras in the visible spectrum, night vision weapons cameras, weapons cameras linked to helmet sights, laser target designators, micro flare launchers, IFF (Identify Friend or Foe) beacons and/or transmitters, bayonets using rail-type mounts, prismatic sights for aiming around corners without exposing users to enemy fire, signal devices/strobes, and miscellaneous sensors. Other accessories may also be used or adapted for use with the quick detach accessory mount of the present application.

Some examples of flashlights and/or illuminators that may be used in combination with the quick detach accessory mount of the present application may include: SureFire P2X Fury Light, stock-keeper unit (SKU) 770-055-606, manufactured by LaRue Tactical, located at 850 CR 177, Leander, Tex. 78641; M1 Infrared Illuminator, NATO Stock Number (NSN) 5855-01-529-5375, manufactured by SureFire, LLC, headquartered at 18300 Mount Baldy Circle, Fountain Valley, Calif. 92708; and RAID™ WeaponLight—White and IR Output M720V, NSN 6230-01-590-2412 and 6230-01-592-9028, manufactured by SureFire, LLC, headquartered at 18300 Mount Baldy Circle, Fountain Valley, Calif. 92708.

An example of a laser sight that may be used in combination with the quick detach accessory mount of the present application may include a Nc Star APRLSMG Pistol And Rifle Green Laser With Weaver Mount/Pressure Switch, UPC 814108015176, manufactured by NcSTAR, headquartered at 18031 Cortney Ct., City of Industry Calif. 91748.

Some examples of combination devices combining a laser sight and an illuminator that may be used in combination with the quick detach accessory mount of the present application may include: SureFire X400® LED Handgun/Long Gun WeaponLight with Red Laser, NSN 6230-01-579-1382, manufactured by SureFire, LLC, headquartered at 18300 Mount Baldy Circle, Fountain Valley, Calif. 92708; and EOTech AN/PEQ-2A Infrared Aiming Laser and IR Illuminator Light ITP-500C-A2, MPN: ITP-500C-A2, manufactured by EOTech, located at 1201 E. Ellsworth, Ann Arbor, Mich. 48108.

Some examples of bipods that may be used in combination with the quick detach accessory mount of the present application may include: Harris BR-S and LT706 QD Combo, SKU: 680-001-706; Harris Bipod 9-13" LM-S and LT706 QD Swivel Mount Combo, SKU: 680-002-706; Harris Bipod BRM-S and LT706 QD Swivel Mount Combo, SKU: 680-005-706; Harris Bipod BRM and LaRue Tactical LT130 QD Mount, SKU: 680-004-130; Harris Bipod BRM-S and LaRue Tactical LT130 QD Mount, SKU: 680-005-130; Harris Bipod LM and LaRue Tactical LT130 QD Mount, SKU: 680-003-130; Harris Bipod LM-S and LaRue Tactical LT130 QD Mount, SKU: 680-002-130; and Harris Bipod BR-S and LaRue Tactical LT130 QD Mount, SKU: 680-001-130. The above-listed bipods are manufactured by LaRue Tactical, located at 850 CR 177, Leander, Tex. 78641.

An example of a non-lethal visual disruption laser that may be used in combination with the quick detach accessory mount of the present application may include the GLARE® MOUT 532P-M, NSN 1265-01-558-5814, manufactured by B.E. Meyers, headquartered at 9461 Willows Rd NE, Redmond Wash. 98052.

Some examples of weapons cameras that may be used in combination with the quick detach accessory mount of the present application may include the Adrenaline Systems Gun Cams, available for order through the website: http://www.adrenalinecamera.com/.

An example of a micro flare launcher that may be used in combination with the quick detach accessory mount of the present application may include the LaRue Tactical MK31 Pen Flare QD Mount LT663, SKU: LT663, manufactured by LaRue Tactical, located at 850 CR 177, Leander, Tex. 78641.

One feature or aspect of an embodiment is believed at the time of the filing of this patent application to possibly reside broadly in a method of using an accessory mount in combination with a rifle, said accessory mount comprising: a barrel ring being configured and disposed to fit around a barrel of a rifle; said barrel ring being configured to expand and being further configured to slide over a muzzle of a barrel of a rifle upon said barrel ring being expanded; said barrel ring being configured to be tightened and being further configured to be locked into place around a barrel of a rifle; a locking mechanism being configured to rotate between a first, closed position and a second, open position; said locking mechanism comprising a lever; said locking mechanism being configured to permit opening and closing of said barrel ring; said locking mechanism being further to configured to expand said barrel ring to permit said expanded barrel ring to slide over a muzzle of a rifle; a T-shaped slot being disposed opposite said locking mechanism and being configured to accept a bayonet lug of a rifle; a ball detent being configured and disposed to engage a bayonet lug of a rifle; levers being configured and disposed to engage a bayonet lug of a rifle; said levers each comprising a finger grip being configured and disposed to be grasped by fingers and/or thumbs of a user; and a plurality of rails being configured and disposed to accept accessories, such as lasers, flashlights, various illuminators, bipods, and other accessories; said method comprising the steps of: attaching an accessory mount onto a rifle by: rotating a locking mechanism of an accessory mount from a first, closed position into a second, open position, and opening a barrel ring of said accessory mount; expanding said barrel ring of said accessory mount to permit said barrel ring to slide over a muzzle of a barrel of a rifle; sliding said opened barrel ring of said accessory mount over the muzzle of a barrel of a rifle and disposing said barrel ring around said barrel of said rifle; positioning said accessory mount, with said barrel ring disposed around said barrel of said rifle such that a T-shaped slot of said accessory mount abuts a bayonet lug of said rifle; snapping said bayonet lug of said rifle into said T-shaped slot of said accessory mount, engaging a ball detent and levers of said accessory mount to said bayonet lug of said rifle, and snapping said accessory mount onto said rifle; and rotating said locking mechanism of said accessory mount from said second, open position into said first, closed position, closing said barrel ring of said accessory mount; tightening said locking mechanism of said accessory mount to lock said accessory mount onto said rifle; mounting accessories onto said accessory mount and said rifle by engaging accessories onto at least one rail of said accessory mount by: engaging a first accessory, such as a flashlight, onto a first rail of said at least one rail; engaging a second accessory, such as a laser, onto a second rail of said at least one rail; and engaging a third accessory, such as a bipod, onto a third rail of said at least one rail; dismounting accessories from said accessory mount and said rifle by disengaging accessories from said at least one rail of said accessory mount by: disengaging a first accessory, such as a flashlight, from said first rail of said at least one rail; disengaging a second accessory, such as a laser, from said second rail of said at least one rail; and disengaging a third accessory, such as a bipod, from said third rail of said at least one rail; and detaching said accessory mount from said rifle by: rotating said locking mechanism of said accessory mount from said first, closed position into said second, open position, opening said barrel ring of said accessory mount, and unlocking said accessory mount from said rifle; grasping finger grips of said accessory mount, with fingers and/or thumbs of a user, and opening levers of said accessory mount; disengaging said ball detent of said accessory mount from said bayonet lug, sliding said bayonet lug of said rifle out of said T-shaped slot of said accessory mount, and dislodging said accessory mount from said rifle; and sliding said opened barrel ring of said accessory mount over said muzzle of said rifle and removing said accessory mount from said rifle.

What is claimed is:

1. A method of using an accessory mount in combination with a rifle, said accessory mount comprising:

a barrel ring being configured and disposed to fit around a barrel of a rifle;

said barrel ring being configured to expand and being further configured to slide over a muzzle of a barrel of a rifle upon said barrel ring being expanded;

said barrel ring being configured to be tightened and being further configured to be locked into place around a barrel of a rifle;

a locking mechanism being configured to rotate between a first, closed position and a second, open position;

said locking mechanism comprising a lever;

said locking mechanism being configured to permit opening and closing of said barrel ring;

said locking mechanism being further to configured to expand said barrel ring to permit said expanded barrel ring to slide over a muzzle of a rifle;

a T-shaped slot being disposed opposite said locking mechanism and being configured to accept a bayonet lug of a rifle;

a ball detent being configured and disposed to engage a bayonet lug of a rifle;

levers being configured and disposed to engage a bayonet lug of a rifle;

said levers each comprising a finger grip being configured and disposed to be grasped by fingers and/or thumbs of a user; and a plurality of rails being configured and disposed to accept accessories;

said method comprising the steps of:

attaching an accessory mount onto a rifle by:

rotating a locking mechanism of an accessory mount from a first, closed position into a second, open position, and opening a barrel ring of said accessory mount;

expanding said barrel ring of said accessory mount to permit said barrel ring to slide over a muzzle of a barrel of a rifle;

sliding said opened barrel ring of said accessory mount over the muzzle of a barrel of a rifle and disposing said barrel ring around said barrel of said rifle;

positioning said accessory mount, with said barrel ring disposed around said barrel of said rifle such that a T-shaped slot of said accessory mount abuts a bayonet lug of said rifle;

snapping said bayonet lug of said rifle into said T-shaped slot of said accessory mount, engaging a ball detent and levers of said accessory mount to said bayonet lug of said rifle, and snapping said accessory mount onto said rifle; and rotating said locking mechanism of said accessory mount from said second, open position into said first, closed position, closing said barrel ring of said accessory mount;

tightening said locking mechanism of said accessory mount to lock said accessory mount onto said rifle;

mounting accessories onto said accessory mount and said rifle by engaging accessories onto a plurality of rails of said accessory mount by:

engaging a first accessory onto a first rail of said plurality of rails;

engaging a second accessory onto a second rail of said plurality of rails; and engaging a third accessory onto a third rail of said plurality of rails;

dismounting accessories from said accessory mount and said rifle by disengaging accessories from said plurality of rails of said accessory mount by:

disengaging a first accessory from said first rail of said plurality of rails;

disengaging a second accessory from said second rail of said plurality of rails; and disengaging a third accessory from said third rail of said plurality of rails; and detaching said accessory mount from said rifle by:

rotating said locking mechanism of said accessory mount from said first, closed position into said second, open position, opening said barrel ring of said accessory mount, and unlocking said accessory mount from said rifle;

grasping finger grips of said accessory mount, with fingers and/or thumbs of a user, and opening levers of said accessory mount;

disengaging said ball detent of said accessory mount from said bayonet lug, sliding said bayonet lug of said rifle out of said T-shaped slot of said accessory mount, and dislodging said accessory mount from said rifle; and sliding said opened barrel ring of said accessory mount over said muzzle of said rifle and removing said accessory mount from said rifle.

* * * * *